United States Patent [19]

Kusz et al.

[11] Patent Number: 4,732,537

[45] Date of Patent: Mar. 22, 1988

[54] AIR OPERATED PUMP AND MOTOR

[75] Inventors: John P. Kusz, Chicago; Thomas J. Danowski, Streamwood, both of Ill.

[73] Assignee: Safety-Kleen Corporation, Elgin, Ill.

[21] Appl. No.: 79,943

[22] Filed: Jul. 31, 1987

[51] Int. Cl.[4] ..... F01D 25/32

[52] U.S. Cl. ..... 415/205; 417/407; 415/90; 415/202

[58] Field of Search ..... 415/203, 204, 205, 202, 415/90; 417/406, 407

[56] References Cited

U.S. PATENT DOCUMENTS

| | | | |
|---|---|---|---|
| 865,133 | 9/1907 | Stevens | 417/406 |
| 3,210,848 | 10/1965 | Bizzigotti | 415/202 |
| 3,227,087 | 1/1966 | Albee et al. | 415/219 C |
| 3,794,448 | 2/1974 | Albertson | 415/90 |
| 3,923,416 | 12/1975 | Frey | 415/90 |
| 4,016,893 | 4/1977 | Scott | 417/406 |
| 4,669,951 | 6/1987 | Stern | 415/90 |

FOREIGN PATENT DOCUMENTS

| | | | |
|---|---|---|---|
| 113576 | 8/1941 | Australia | 417/407 |
| 57821 | 6/1911 | Switzerland | 417/406 |

*Primary Examiner*—Robert E. Garrett
*Assistant Examiner*—John T. Kwon
*Attorney, Agent, or Firm*—James T. FitzGibbon; Angelo J. Bufalino

[57] ABSTRACT

An air operated pump and motor unit with a rotor head assembly, an impeller head assembly, and a spacer tube unit disposed between these assemblies. The impeller head includes a pumping chamber and a liquid impeller assembly, and the rotor head includes a rotor housing, a cover assembly, and a rotor element. The rotor has a hub carrying a drive shaft and the rotor includes a plurality of radially extending blades and a spider unit joining the rotor hub to the blade carrier. The rotor hub and the spider lie adjacent the inner end of the housing and the carrier lies adjacent the cover, so that the rotor subdivides the rotor chamber into upstream and downstream chambers communicating with each other through passages in the spider. In use, the air passes from the upstream chamber to the downstream chamber through the openings in the spider and from the downstream chamber to the atmosphere.

11 Claims, 4 Drawing Figures

AIR OPERATED PUMP AND MOTOR

BACKGROUND OF THE INVENTION

The present invention relates generally to a combination pump and motor adapted for operation by compressed air, and more particularly, to a form of air operated pump and motor, which is particularly adapted for use in circulating washing fluid such as solvent or the like where a source of compressed air is readily available.

In apparatus such as washers for parts, tools and the like, including those disclosed and claimed in U.S. Pat. No. 3,522,814, for example, and in U.S. Pat. No. 4,462,415, small electric motors are used to operate pumps for withdrawing solvent from a receptacle such as a drum or specially contoured container. The pump then circulates the solvent from the reservoir through a hose or the like into a sink area where the liquid flow may be directed onto parts or the like being washed and returned from there to the reservoir. In some case, filters may be provided to remove contaminants from the solvent.

While electric motors have a number of advantages for this purpose, there are certain advantages to air operated motors which may make them more attractive for this application. Assuming that a source of compressed air is available to operate a motor, compressed air has certain advantages over electric motors, including the total elimination of a fire hazard resulting from sparks incident to electrical short circuits and the like.

Air operated motors are not normally susceptible of overheating even when intentionally stopped, for example. Consequently, motors such as this do not burn out and are not the subject of safety hazards caused by undue temperatures which may cause solvent flashing or even fire or explosion.

Still further, it is often desired to provide a variable pumping rate and/or discharge pressure from the pump in question. While variable speed electric motors are known, these ordinarily require control circuits which make them much more expensive than counterpart single speed motors.

On the other hand, it is a very simple matter to adjust the speed of an air operated motor, simple by manipulating a flow rate or pressure control valve for the supply of air to reduce the volume and/or pressure of the air being fed to the motor.

While heretofore known air operated motors serving to actuate liquid pumps have possessed the foregoing and other advantages, a number of them have possessed certain disadvantages, including air flow paths leading to noisy operation, lack of easy controllability, noisy air discharge, and difficulty of adaption to varying lift heights and the like. Still other such motors have required parts that were somewhat difficult to fabricate and assemble, raising their cost above a minimum which would make them desirable for reliable operation at minimum cost.

According to the invention, an air operated pump and motor is provided wherein a simplified combination rotor and housing construction is featured and wherein the impeller of the pump may be spaced apart from the rotor of the motor by any desirable length.

In view of the failure of the prior art to provide a pump and motor having the advantages and characteristics desired for certain applications, including parts washers and other fluid pumps, it is an object of the present invention to provide an improved air operated pump and motor.

Another object of the invention is to provide an air operated pump and motor having a particular form of air operated turbine assembly formed by combination of a rotor having a plurality of radial vanes or blades positioned on an imperforate carrier having a series of axially extending discharge ports located near its inner diameter and lying axially opposite, and preferably radially inwardly from, the outlet ports for the rotor chamber.

Another object of the invention is to provide a pump construction which includes a rotor assembly disposed in a housing and serving to subdivide the interior of the housing into primary and secondary air chambers, and wherein the rotor includes a vented hub section, with the chamber also including closely spaced apart inner and outer covers providing an air diffuser with a peripheral outlet communicating with the secondary air chamber.

Another object of the invention is to provide a pump and motor wherein the rotor and pump impeller assemblies are disposed on a common shaft and spaced axially apart from each other, and are retained in this relation by a rigid sleeve assembly which may be varied in length for various pump applications without the requirement that other changes be made to the motor.

Another object of the invention is to provide an air operated pump and motor which includes an impeller in a lower chamber with peripheral inlets, one or more volutes directing fluid flow to an upwardly directed passage extending from the volute area to the pump outlet.

The foregoing and other objects and advantages of the invention are achieved in practice by providing a combination air operated pump and motor having a rotor head portion with an imperforate blade carrier affixed by a spider to a drive shaft hub and disposed in a housing which the rotor subdivides into primary and secondary air chambers, and wherein the rotor head also includes inner and outer spaced apart covers which provide an air diffuser with a peripheral outlet; the pump includes an impeller disposed in a lower housing and driven by a shaft affixed to the rotor.

The exact manner in which these and other inherent objects of the invention are achieved in practice will become more clearly apparent when reference is made to the following detailed description of the preferred embodiments of the invention set forth by way of example, and shown in the accompanying drawings, in which like reference numbers indicate corresponding parts throughout.

DESCRIPTION OF THE PREFERRED EMBODIMENTS OF THE INVENTION

Figure 1:
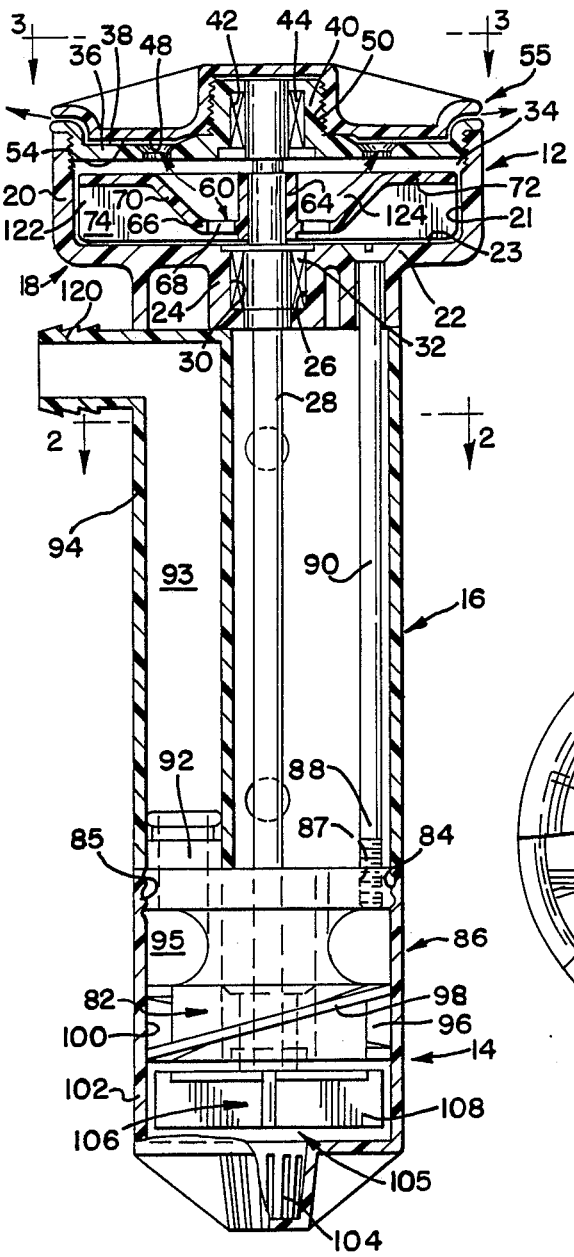
FIG. 1 is a vertical sectional view of the pump and motor assembly of the invention, showing the essential elements thereof.
Figure 2:
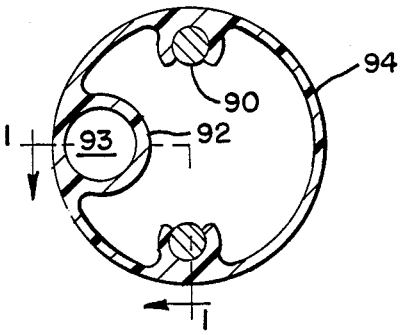
FIG. 2 is a horizontal sectional view taken along line 22 of FIG. 1.

While it will be understood that the pump and motor assembly of the invention may be made in different forms which differ as among themselves in constructional details, and while it will be further understood that the pump and motor may be made from different materials of construction, a preferred form thereof will be described wherein the pump and motor are made largely from plastic materials and wherein the overall height of the pump is some eight or nine inches, with the liquid being circulated comprising a stoddard solvent or like material used in for cleaning mechanical parts and the like.

Referring now to the drawings in greater detail, an air operated pump and motor embodying the invention is shown. Generally designated 10, this pump and motor includes three principle components, a rotor head assembly generally designated 12, a liquid impeller head assembly generally designated 14, and a generally tubular spacer element generally designated 16 and shown to include a hollow tube for the passage of liquid pump by the impeller assembly 14.

As shown in FIG. 1, the rotor head assembly 12 includes an outer housing generally designated 18 and shown to comprise a generally cylindrical sidewall 20 having an inner surface 21 and a radially extending bottom wall 22 shown to have an axially upwardly directed inner surface 23.

The housing 18 also includes a lower shaft carrier portion 24 of generally cylindrical configuration and shown to include a passage 26 exending therethrough for positioning a drive shaft 28 within a counterbore 30 formed in the carrier 24. Preferably, a metal or like bearing or bushing in 32 is positioned in the counterbore to provide journaling for the shaft 28.

Figure 4:
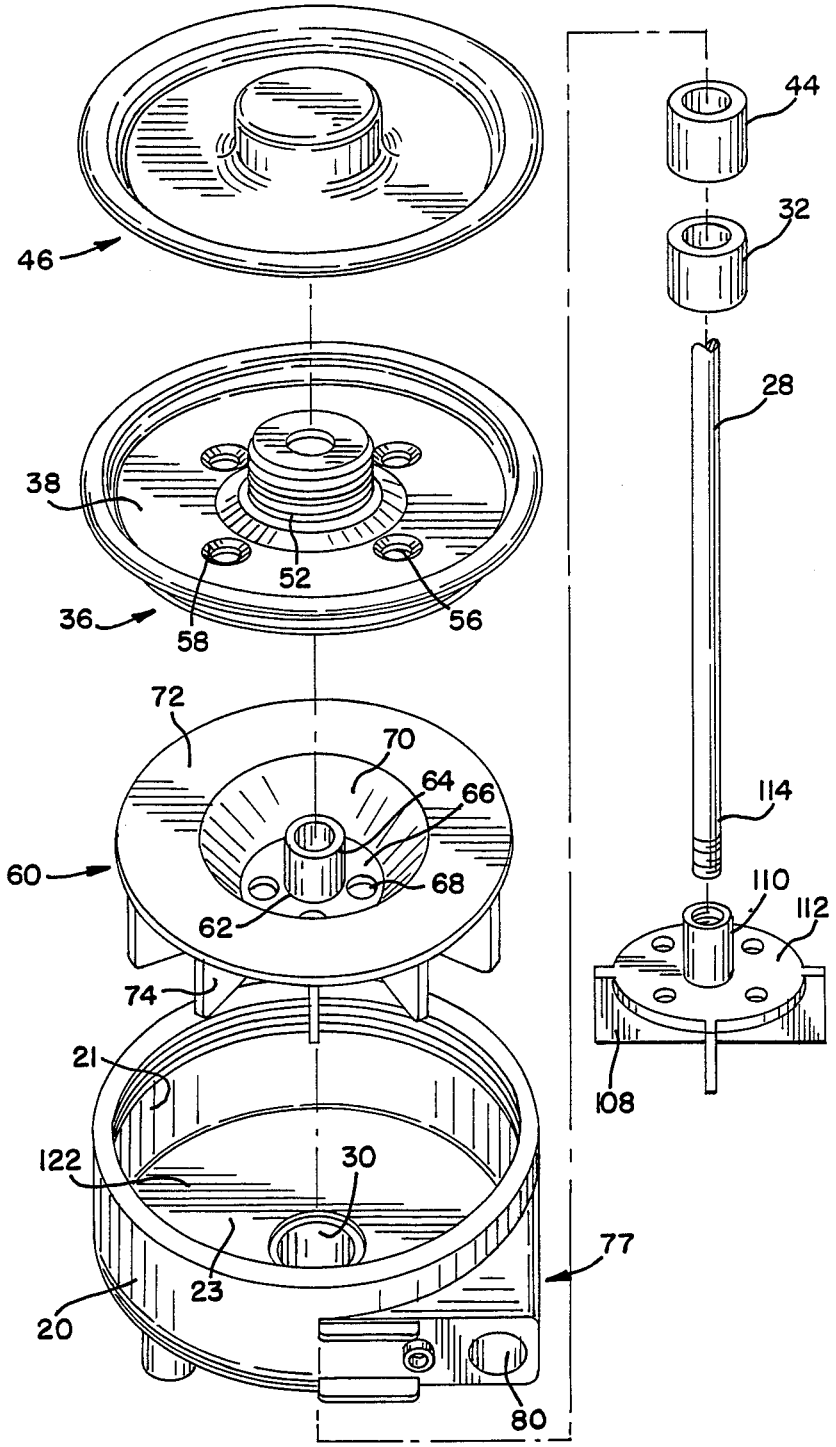
FIG. 4 is a exploded perspective view showing the certain principle elements of the pump and motor of the invention.

Referring again to the rotor head assembly housing 18, the axially outer or upper portions of the sidewall 20 are shown to include threads 34 on the inner surface thereof for engagement with counterpart threads formed on an inner cover 36 of generally flat, circular configuration. The FIG. 4 shows the cover element in detail. As shown, this inner cover includes a top surface portion 38, an upper shaft carrier hub 40 having a bearing carrier pocket 42 formed on its inner surface and receiving an upper shaft bearing 44. The exterior part of the upper shaft carrier hub also serves to position an outer cover generally designated 46 in FIG. 4 and this cover includes a bottom surface 48 and positioning means in the form of a threaded opening 50. This cover cooperates or is adapted to be received in snug positioning relation with respect to cooperating exterior threads 52 formed on the upper shaft carrier hub 40.

As shown in FIG. 1, the oppositely directed surfaces 38, 48 and the inner and outer covers are spaced apart from each other by a small distance, perhaps 1 millimeter, to define therebetween an air diffusion zone 54 which extends radially outwardly and terminates in a peripheral vent outlet generally designated 55. The inner cover 36 includes vent means 56 in the form of a plurality of spaced apart passages each preferably including bevelled edge portions 58.

Positioned within the housing 18 is a rotor assembly generally designated 60 and shown to include a rotor hub unit 62, of cylindrical form, and including a shaft receiving sleeve 64 of generally cylindrical form. Affixed to and extending outwardly from the axially inner or lower portion of the sleeve 64 is a spider assembly 66, that is a radially outwardly extending flange having a plurality of air vent passages 68 spaced evenly apart and adapted to afford pneumatic communication from the area beneath the rotor assembly to the portion above it.

FIGS. 1 and 4 also show that the rotor assembly includes circumferentially continuous, imperferate inner and outer blade carrier element 70, 72. A plurality of blades 74 are attached to the lower or axially inner surfaces of the elements 70, 72, with the blades having principle or radially outer portions and in intermediate sections of reduced axial extent. The inner blade carrier element 70 provides attachment and axial offset between the outer edge of the spider assembly 66 and the inner edge of the outer blade carrier 72, which is an important feature of the invention and to which a reference is made elsewhere herein.

Figure 3:
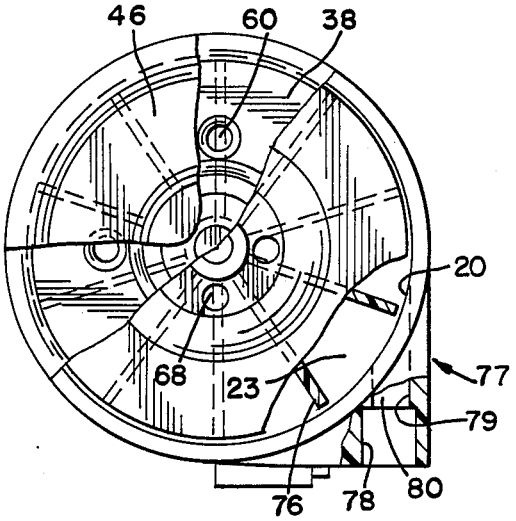
FIG. 3 is a top plan view, with portions broken away and partly an elevation and partly in section, showing certain elements of the rotor unit and the inner and outer cover of the of the rotor head assembly.

As shown in FIGS. 3 and 4, the blades 74 include outer ends or tips 76 which are adapted to receive impetus from a jet of pressurized air to cause rotation of the assembly 60. For this purpose, the housing 18 includes a formation generally designated 77 extending radially away from one of its sidewalls which includes a counterbore 78 for receiving a fitting and a reduced diameter primary bore 79 providing a passage 80 for high pressure inlet air.

Referring now to the impeller head assembly 14, this element is shown in FIG. 1 to include a unitary body generally designated 82 and shown to include a threaded end portion 84 adapted to cooperate with the threads 85 formed in the inner, upper surface portion of a cap assembly generally designated 86. The body 82 also includes one or more tapped openings 87 to receive the threaded lower end portion 88 of a long fastener 90 which extends between a portion of the outer housing 18 and the body 82.

The impeller head body 82 is also shown to include a vertically extending liquid outlet passage 92 communicating with the interior 93 of a liquid flow tube 94 forming a part of the spacer 16. A sidewall portion of the body 82 includes a collector annulus 95 and a volute area 96 preferably defined by a pair of spiral flutes 98 which lie closely adjacent to an inner surface 100 of a sleeve portion 102 of the cap 86.

A plurality of inlet passages 104 are formed in the center and lower ends of the cap 86 and allow passage of fluid into an impeller chamber generally designated 105. In this area, a liquid impeller generally designated 106 is positioned, and this unit is shown to include a plurality of blades 108 carried on a cylindrical hub 110 and covered on their axially inner or upper surface by a blade carrier plate 112. A lower end 114 of the shaft 28 is threaded for snug reception into the inner diameter of the cylindrical hub 110.

Accordingly, it will be seen that fluid passing through the inlet passages 104 will enter the impeller chamber 105 and be propelled by the blades 108 to a radially outward area wherein the momentum of the liquid, combined with the spiral flutes 98 propel it to the collector annulus 95 and ultimately through the passage and tube 93.

Referring now to the operation of the device, I will assume that the pump is placed in a washer or the like from where it is desired to circulate liquid from beneath the surface of a mass of liquid and into the outlet tube or hose (not shown) affixed to a liquid outlet 120 in FIG. 1. A source of compressed or "shop" air is connected as by suitable fittings (not shown) to the counterbore 78 disposed in the formation 77 of the housing 18.

When the trigger or other switch is actuated, a stream of compressed air is directed at high velocity through the passage 80 and impinges on the tips or outer edges 76 of the rotor blades 74. This causes the rotor assembly 60 to rotate rapidly. As increased air is admitted into and along the sidewalls 20, the air is confined in what may be considered a primary air chamber 122 defined by the lower surfaces of the inner and outer blade carrier elements 70, 72. As the air loses its momentum and energy, it flows axially downwardly and radially inwardly, and finally through the air vent passages 68 in the spider assembly 66. From here, the air passes to the secondary air chamber 124 defined in part by the upper surfaces of the spider assembly 66 and the inner blade carrier element 70 and the lower surfaces of the inner cover 36. Finally, the air flows through the passages 68 and out the peripheral vent outlet 55 of the diffuser assembly.

The passage of the air in this manner not only achieves maximum utilization in propelling the rotor, but the diffusion path also insures that the exhaust air has changed direction of plurality of times and has lost considerable velocity. The peripheral vent outlet 55 from the diffusion chamber has a much greater cross sectional area than the area through which the exhausted air has passed by way of the passages 68 in the spider assembly 66. Consequently, the noise level is minimal and a significant volume of air supplied at from 30 to 50 psi or even higher may be accommodated to pump a significant head of liquid without creating objectionable noise in the workplace. As the rotor rotates at a high speed, the impeller 106 is driven and draws liquid as described above through the plurality of inlet passages 104 into the impeller chamber 105 and finally up the interior of the flow tube 93 and to the associated hose for direction to a desired discharge area.

In the embodiment shown, the liquid flow tube 94 may be made of any suitable length in combination with the spacer element 16. Then thereupon, by selecting the proper length of the long fastener 90, any desired below-surface depth may be selected for the pump without altering the relatively complex parts of the pump and motor assembly.

The ability of the pump to supply a certain had or height of liquid above the static liquid level naturally depends on the size and shape of the components and the clearances in the air passages. However, significant flow may be obtained in one application, such as a parts washer using stoddard solvent or the like, wherein the lift distance is between 9 inches and 3 feet and at a flow rate of several gallons per minute, this may be comfortably achieved by regulated air supplied at a pressure of 40 psi through a small diameter shop hose. Pressure regulators and flow rate regulators of a known kind may be provided to achieve these operating parameters.

Of course closer clearances and higher air pressure can create a larger available pressure head. The design of the pump provides an air flow path from the primary air chamber 122 to the secondary air chamber 124 through vents in a spider assembly 66 located axially inwardly of the blade carrier elements 70, 72. The air then flows from the secondary chamber through a radial diffuser formed between opposed facing surfaces 38 and 48 of the inner and outer covers 36, 46 respectively.

The pump of the invention is extremely satisfactory from the standpoint of noise level. Manufacturing costs may be held to a minimum by a modular construction of the parts as indicated. In this connection, while the fasteners, such as the fastener 90 and the drive shaft 28 may be made from metal, as can be the bearings 32 44, the remaining elements may be made from plastic material such as polycarbonate, glass filled nylon, or other available materials and may be formed to precise tolerances by injection molding. The provision of the enlarged and reduced diameter threaded portions and the carrying of the outer shaft bearing by the inner cover element is a manufacturing and service advantage of the unit not believed available in the prior art.

It will thus be seen that the invention provides a novel air operated pump and motor having a number of novel advantages and characteristics, including those referred to specifically herein and others which are inherent in the invention. A preferred form of pump and motor of the invention having been described in detail, by way of example, it is anticipated that the variations in the described form of construction may occur to those skilled in the art, and that such variations may be made without departing from the spirit of the invention or the scope of the appended claims.

What is claimed is:

1. An air operated pump and motor unit for transferring liquid from beneath a liquid surface to a a point above the liquid surface, said pump and motor unit comprising, in combination, a rotor head assembly, an impeller head assembly, and a spacer tube unit disposed between said assemblies and affixed and its upper and lower ends respectively to said rotor and impeller assemblies, said impeller head assembly including means defining a pumping chamber with at least one liquid inlet and at least one liquid outlet, a liquid discharge line extending from said liquid chamber outlet to a liquid discharge outlet, a liquid impeller assembly disposed within said pumping chamber and including a plurality of blades each carried by an impeller hub, said rotor head assembly comprising a rotor housing having an inner end face, a radially inwardly directed cylindrical sidewall portion and a cover assembly closing off the top of said rotor housing and having an axially inner surface spaced from and in facing relation to said inner end face of said housing, said sidewall and end facer thereby defining an air chamber for said rotor element, a rotor element disposed within said chamber and mounted for rotation about a drive shaft axis, said rotor element having a hub affixed at its center to a drive shaft extending from said rotor hub and being joined to said impeller hub, said rotor element also having a blade carrier unit of generally annular form and having a plurality of radially extending blade units disposed on the side of said annular blade carrier facing said housing inner end face, and a spider unit extending between and joining said rotor hub and said blade carrier and also providing plurality of passages for axial airflow therethrough, said rotor hub and said spider lying adjacent said housing inner end face, with said carrier having portions lying adjacent said cover assembly axially inner surface, said rotor assembly thereby subdividing said rotor chamber into upstream and downstream chambers communicating with each other through said passages in said spider, said rotor housing also including means defining at least one high pressure inlet in said sidewall portion, said cover assembly including an inner cover unit and an outer cover unit spaced closing axially apart from each other to define therebetween a radially extending diffuser passage, said inner cover unit further including a plurality of passages extending axially between said downstream chamber and said diffuser passage, whereby air passes in use from said air inlet to said upstream chamber, and then to said downstream chamber through said axial spider passages, and thereafter through said cover passages to and through said diffuser passages.

2. An air operated pump and motor unit as defined in claim 1 wherein said inner cover unit is threadedly received within an upper portion of said cylindrical sidewall portion.

3. An air operated pump and motor unit as defined in claim 1 wherein said inner cover unit is threadedly received within an axially outer margin of said cylindrical sidewall portion of said rotor housing and wherein said rotor housing and wherein said outer cover unit is threadedly received over a portion of said inner cover unit.

4. An air operated pump and motor unit as defined in claim 1 wherein said inner cover unit further includes a center section receiving and positioning a bearing unit for positioning said drive shaft.

5. An air operated pump and motor unit as defined in claim 1 wherein said rotor housing further includes a counterbore formed in said inner endface, said housing further including a bearing received in said counterbore for positioning said drive shaft.

6. An air operated pump and motor unit as defined in claim 1 wherein said liquid discharge line and said liquid discharge outlet forms a part of a spacer tube unit.

7. An air operated pump and motor unit as defined in claim 1 wherein said impeller head body in which said liquid outlet is formed in a portion of said body, with said body further including spiral flutes on the exterior of said body, said flutes being adapted to direct fluid from said impeller to said liquid chamber outlet.

8. An air operated pump and motor unit as defined in claim 1 wherein said impeller head assembly are joined by fasteners extending between said assemblies and through said spacer tube unit, said spacer tube unit being removably positioned by the said head assemblies.

9. An air operated pump and motor unit as defined in claim 1 wherein said blade carrier unit includes radially inner and radially outer portions, said outer portion lying in a plane parallel to and spaced axially closely apart from said cover assembly inner surface, said inner portion being of frustoconical configuration and being joined at its inner margin to said spider in a plane adjacent said housing inner endface.

10. An air operated pump and motor unit as defined in claim 1 wherein said inner and outer cover units include axially off-set, radially outer margins adjacent their respective outer peripheries.

11. In an air operated pump and motor unit for transferring liquid from beneath a liquid surface to a point above the liquid surface, wherein said pump and motor unit comprise a rotor head assembly, an impeller head assembly, and a spacer tube unit disposed between said assemblies and affixed and its upper and lower ends respectively to said rotor and impeller assemblies, and wherein said impeller head assembly includes means defining a pumping chamber with at least one liquid inlet and at least one liquid outlet, a liquid discharge line extending from said liquid chamber outlet to a liquid discharge outlet, and a liquid impeller assembly disposed within said pumping chamber and including a plurality of blades each carried by an impeller hub, said rotor head assembly comprises a rotor housing having an inner end face, a radially inwardly directed cylindrical sidewall portion and a cover assembly closing off the top of said rotor housing and having an axially inner surface spaced from and in facing relation to said inner end face of said housing, said sidewall and end facer thereby defining an air chamber for said rotor element, said rotor housing also including means defining at least one high pressure inlet in said sidewall portion and a rotor element disposed within said chamber and mounted for rotation about a drive shaft axis, said rotor element having a hub affixed at its center to a drive shaft extending from said rotor hub and being joined to said impeller hub, the improvement comprising said rotor element also having a blade carrier unit of generally annular form and having a plurality of radially extending blade units disposed on the side of said annular blade carrier facing said housing inner end face, and a spider unit extending between and joining said rotor hub and said blade carrier and also providing plurality of passages for axial airflow therethrough, said rotor hub and said spider lying adjacent said housing inner end face, with said carrier having portions lying adjacent said cover assembly axially inner surface, said rotor assembly thereby subdividing said rotor chamber into upstream and downstream chambers communicating with each other through said passages in said spider, with said rotor housing also including means defining at least one high pressure inlet in said sidewall portion, said cover assembly including an inner cover unit and an outer cover unit spaced closing axially apart from each other to define therebetween a radially extending diffuser passage, said inner cover unit further including a plurality of passages extending axially between said downstream chamber and said diffuser passage, whereby air passes in use from said air inlet to said upstream chamber, and then to said downstream chamber through said axial spider passages, and thereafter through said cover passages to and through said diffuser passages.

* * * * *